US008783008B2

(12) United States Patent
Eroglu et al.

(10) Patent No.: US 8,783,008 B2
(45) Date of Patent: Jul. 22, 2014

(54) GAS TURBINE REHEAT COMBUSTOR INCLUDING A FUEL INJECTOR FOR DELIVERING FUEL INTO A GAS MIXTURE TOGETHER WITH COOLING AIR PREVIOUSLY USED FOR CONVECTIVELY COOLING THE REHEAT COMBUSTOR

(75) Inventors: Adnan Eroglu, Untersiggenthal (CH); Thiemo Meeuwissen, Ennetbaden (CH); Peter Flohr, Turgi (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 13/474,422

(22) Filed: May 17, 2012

(65) Prior Publication Data

US 2012/0260665 A1 Oct. 18, 2012

Related U.S. Application Data

(63) Continuation of application No. PCT/EP2010/066804, filed on Nov. 4, 2010.

(30) Foreign Application Priority Data

Nov. 17, 2009 (GB) ..... 0920094.0

(51) Int. Cl.
*F02C 1/06* (2006.01)
*F23R 3/28* (2006.01)
*F23R 3/34* (2006.01)

(52) U.S. Cl.
CPC . *F23R 3/286* (2013.01); *F23R 3/34* (2013.01); *F23R 2900/03341* (2013.01); *F23R 2900/03342* (2013.01)
USPC ..... 60/39.17; 60/733; 60/774; 60/39.5; 60/806

(58) Field of Classification Search
CPC .. F23R 3/286; F23R 3/34; F23R 2900/03342; F23R 2900/03341
USPC ..... 60/39.17, 791, 733, 39.5, 774, 737, 60/752–760, 782, 785, 805, 806, 734, 738, 60/739, 740–748
See application file for complete search history.

(56) References Cited

U.S. PATENT DOCUMENTS 5,297,391 A * 3/1994 Roche ..... 60/740
5,484,258 A * 1/1996 Isburgh et al. ..... 415/115

(Continued)

FOREIGN PATENT DOCUMENTS

DE 196 31 616 A1 2/1998
DE 198 10 648 A1 9/1999

(Continued)

OTHER PUBLICATIONS

United Kingdom Search Report issued on Mar. 1, 2010, Application No. GB0920094.0.

(Continued)

*Primary Examiner* — William H Rodriguez
(74) *Attorney, Agent, or Firm* — Buchanan Ingersoll & Rooney P.C.

(57) ABSTRACT

A reheat combustor for a gas turbine engine includes a fuel/gas mixer for mixing fuel, air and combustion gases produced by a primary combustor and expanded through a high pressure turbine. Fuel injectors inject fuel into the mixer together with spent cooling air previously used for convectively cooling the reheat combustor. The fuel mixture is burnt in an annular reheat combustion chamber prior to expansion through low pressure turbine inlet guide vanes. The fuel/gas mixer and optionally the combustion chamber define cooling paths through which cooling air flows to convectively cool their walls. The fuel injectors are also convectively cooled by the cooling air after it has passed through the fuel/gas mixer cooling paths. The low pressure turbine inlet guide vanes may also define convective cooling paths in series with the combustion chamber cooling paths.

18 Claims, 5 Drawing Sheets

(56) References Cited

U.S. PATENT DOCUMENTS

| | | | | |
|---|---|---|---|---|
| 5,497,611 | A * | 3/1996 | Benz et al. | 60/776 |
| 5,680,767 | A * | 10/1997 | Lee et al. | 60/760 |
| 5,689,948 | A * | 11/1997 | Frutschi | 60/774 |
| 5,765,376 | A * | 6/1998 | Zarzalis et al. | 60/748 |
| 5,782,076 | A * | 7/1998 | Huber et al. | 60/782 |
| 6,038,848 | A * | 3/2000 | Frutschi | 60/775 |
| 6,079,197 | A | 6/2000 | Attia | |
| 6,351,947 | B1 * | 3/2002 | Keller et al. | 60/725 |
| 6,691,503 | B2 * | 2/2004 | Tiemann | 60/39.17 |
| 6,817,187 | B2 * | 11/2004 | Yu | 60/774 |
| 7,464,555 | B2 * | 12/2008 | Bachovchin et al. | 60/777 |
| 7,568,335 | B2 * | 8/2009 | Althaus | 60/39.17 |
| 7,810,332 | B2 * | 10/2010 | Olmes et al. | 60/728 |
| 8,375,723 | B2 * | 2/2013 | Benz et al. | 60/774 |
| 2002/0148213 | A1 * | 10/2002 | Yu | 60/39.17 |
| 2006/0272331 | A1 * | 12/2006 | Bucker et al. | 60/774 |
| 2007/0033942 | A1 | 2/2007 | Benz et al. | |
| 2009/0044539 | A1 * | 2/2009 | Eroglu et al. | 60/742 |
| 2011/0314825 | A1 * | 12/2011 | Stryapunin et al. | 60/737 |

FOREIGN PATENT DOCUMENTS

| | | | |
|---|---|---|---|
| EP | 0 670 456 | A1 | 9/1995 |
| GB | 2 373 299 | B | 10/2004 |
| WO | 2006/053825 | A1 | 5/2006 |
| WO | 2009/109448 | A1 | 9/2009 |

OTHER PUBLICATIONS

Notification of Transmittal of the International Search Report (Forms PCT/ISA/220 and PCT/ISA/210) and the Written Opinion of the International Searching Authority, or the Declaration (Form PCT/ISA/237) dated Oct. 29, 2012, issued in corresponding International Application No. PCT/EP2010/066804. (10 pages).

* cited by examiner

GAS TURBINE REHEAT COMBUSTOR INCLUDING A FUEL INJECTOR FOR DELIVERING FUEL INTO A GAS MIXTURE TOGETHER WITH COOLING AIR PREVIOUSLY USED FOR CONVECTIVELY COOLING THE REHEAT COMBUSTOR

RELATED APPLICATION(S)

This application claims priority as a continuation application under 35 U.S.C. §120 to PCT/2010/066804, which was filed as an International Application on Apr. 11, 2010 designating the U.S., and which claims priority to European Application 0920094.0 filed in Great Britain on Nov. 17, 2009. The entire contents of these applications are hereby incorporated by reference in their entireties.

FIELD

The present disclosure relates to a reheat combustor for a gas turbine engine, to a gas turbine engine including a reheat combustor, and with cooling of a reheat combustor for a gas turbine engine to increase engine efficiency and optimize combustion within the reheat combustor.

BACKGROUND INFORMATION

FIG. 1 is a diagrammatic longitudinal sectional view of part of a reheated or afterburning gas turbine engine 10 above the turbine rotational axis X-X. The gas turbine engine 10 includes a low pressure compressor 12, a high pressure compressor 14, a combustion system 16, a high pressure turbine 18 and a low pressure turbine 20. The combustion system 16 can operate on the reheat or afterburning principle and includes a primary combustor 22 and a reheat combustor 24 located downstream of the primary combustor 22. Both the primary and reheat combustors 22, 24 are annular and extend circumferentially around the turbine axis. The fuel burnt in the combustors can be, for example, oil, or a gas such as natural gas or methane.

In operation, air entering the gas turbine engine 10 is compressed initially by the low pressure compressor 12 and then by the high pressure compressor 14 before the compressed air is delivered to the primary combustor 22. Fuel is injected into the primary combustor 22 by a suitable fuel injector or lance 26, where it mixes with the compressed air. Alternatively, the fuel and air may be at least partially premixed together before the fuel/air mixture is injected into the combustion chamber. A plurality of circumferentially spaced burners 28 then ignite the fuel/air mixture to create hot combustion gases, which are expanded through, and thereby drive, the high pressure turbine 18.

Referring to FIG. 2, which shows a configuration of a known reheat combustor 24 in more detail, the expanded combustion gases are delivered through high pressure turbine outlet guide vanes (HP OGV's) 27 and vortex generators 29 to the reheat combustor 24 for reheating. The reheated combustion gases are directed through low pressure turbine inlet guide vanes (LP IGV's) 35 into the low pressure turbine 20 and exhausted from the engine. Both the high pressure and low pressure turbines 18, 20 are drivingly connected, via suitable connecting shafts, respectively to the high pressure and low pressure compressors 14, 12 which are, thus, driven in a known manner by the high pressure and low pressure turbines 18, 20.

The temperature of the hot combustion gases produced by the primary combustor 22 decreases as those hot combustion gases are expanded through the high pressure turbine 18. Because the power output of a gas turbine engine can be, proportional to the temperature of the combustion gases, it is desirable to reheat the combustion gases that have been expanded through the single-stage high pressure turbine 18 before they are expanded further through the multi-stage low pressure turbine 20. Although a single-stage HP turbine has been described, an HP turbine can have two or more stages if the combustion gases generated by the primary combustor have sufficient energy.

Referring again to FIG. 2, the reheat combustor 24 includes a fuel/gas mixer 30, which can be substantially annular but is segmented into a number of discrete mixing zones 25. The area referenced as 30 is not a continuous annulus but can include individual mixing zones 25 whose circumferential extents are defined by angularly spaced-apart side walls. However, the walls 44, 46, which define the radially inner and outer boundaries of the fuel/gas mixer 30, can be circumferentially continuous, though this is not essential. Each mixing zone 25 has an upstream inlet end 41 to receive the combustion gases 43 that have been expanded through the high pressure turbine and its annular array of outlet guide vanes 27. At the inlet ends 41, the combustion gases 43 pass through vortex generators 29 before fuel is injected into them by a fuel injector 32. The vortex generators 29 aid mixing of the injected fuel with the combustion gases 43 in the fuel/gas mixer 30. The mixture is delivered into an annular combustion chamber 34 through outlets 45 of the mixing zones and the mixture can spontaneously combust due to the heat of the combustion gases.

The number and spacing of the fuel injectors employed should be sufficient to ensure that the circumferential distribution of fuel, air and combustion gases around the mixing zones 25 is sufficiently uniform to enable adequate mixing before combustion occurs. It is desirable if there is one fuel injector per mixing zone of the fuel/gas mixer 30 but this is not an essential characteristic of the fuel/air mixer 30. For example, if each mixing zone has a sufficient circumferential extent, a more even distribution of fuel can be obtained if there are two or more fuel injectors per mixing zone. Assuming one fuel injector per mixing zone, it has been found that a suitable number of fuel injectors and mixing zones in a large heavy duty gas turbine engine can be twenty-four.

As the flame temperature in the reheat combustor 24 increases, the cooling requirements of the walls of the combustion chamber 34 and the fuel/gas mixer 30 can increase, as do the cooling requirements of the HP OGV's 27 and the LP IGV's 35 (FIG. 1). At the same time, the level of undesirable NOx emissions and the danger of premature ignition of the fuel/oxidant mixture can also increase. Hence, to control the level of NOx emissions and generally ensure efficient and reliable operation of the reheat combustor 24, it is desirable to provide suitable cooling for the reheat combustor 24 and associated components.

The HP OGV's 27 and the LP IGV's 35 can be cooled by convective and/or effusion and/or film cooling techniques, the cooling air being supplied from different sources, usually the high pressure and low pressure compressors, respectively. The annular combustion chamber 34 of the known reheat combustor 24 has walls including radially inner and radially outer annular double-walled combustion liners 40, 42, respectively, which can be convectively cooled by a supply of cooling air, which can be drawn from the low pressure compressor 12. The cooling air flows through radially inner and outer cooling paths 36, 38 defined between the double walls of the radially inner and radially outer combustion liners 40, 42. In contrast, the walls of the fuel/gas mixer 30 can be effusion-cooled. Specifically, radially inner and radially outer walls 44, 46 of the fuel/gas mixer 30 both can include a large number of holes having a small diameter (for example, about 0.7 to 0.8 mm) through which cooling air 47 effuses. Furthermore, the dividing walls between adjacent mixing zones 25 of the fuel/gas mixer can also be effusion cooled. The air for effusion cooling can be supplied from the combustion liner flow paths 36, 38, which exhaust into annular plenum chambers adjacent the radially inner and outer fuel/gas mixer walls 44, 46. Due to the acute inclination of the holes relative to the interior surfaces of the radially inner and radially outer fuel/gas mixer walls 44, 46, and the low momentum of the jets of effusion air 47, the effusion air remains close to the interior surfaces of the fuel/gas mixer walls 44, 46, thus keeping them suitably cool. Despite being efficient and reliable, there can be some issues associated with effusion cooling of the fuel/gas mixer 30.

One is that the effusion air 47 may not mix properly with the fuel injected into the mixing zones 25 of the fuel/gas mixer 30 via the fuel injectors 32, whose outlets are located generally centrally between the radially inner and radially outer walls 44, 46 of each individual mixing zone 25. The effusion air does not, therefore, make much contribution to reducing the flame temperature in the annular combustion chamber 34 and thus to reducing the level of undesirable NOx emissions.

To provide cooling for the fuel injectors 32, to reduce the flame temperature and furthermore to ensure that the fuel emerging from the fuel injectors 32 does not combust prematurely in the presence of the relatively high temperature combustion gases, it may be necessary to provide a supply of carrier air. The carrier air is injected into the mixing zones 25 of the fuel/gas mixer 30 with the fuel, through the fuel injectors 32, and can include re-cooled air from the high pressure compressor 14 but the provision of such carrier air is undesirable and can result in loss of efficiency and power.

There is, therefore, a desire for an improved reheat combustor for a gas turbine engine, and for a reheat combustor with improved cooling which provides for the reduction in flame temperature to reduce the level of undesirable NOx emissions and which also minimizes power and efficiency losses within the gas turbine engine.

SUMMARY

A reheat combustor for a gas turbine engine is disclosed comprising a fuel/gas mixer for mixing fuel with combustion gases that have been produced by a primary combustor and expanded through a high pressure turbine, a plurality of fuel injectors for injecting fuel into the fuel/gas mixer and an annular combustion chamber downstream of the fuel/gas mixer, in which the mixture of injected fuel and combustion gases is combusted prior to expansion through a low pressure turbine, a wall of the fuel/gas mixer defining at least one convective cooling path through which cooling air flows, in use, for convectively cooling the fuel/gas mixer, and when the fuel injectors are arranged to inject the cooling air previously used for convective cooling of the fuel/gas mixer into mixing zones of the fuel/gas mixer together with the fuel.

A gas turbine engine is disclosed comprising a low pressure compressor, a high pressure compressor, a primary combustor, a high pressure turbine for expanding combustion gases produced by the primary combustor, a reheat combustor for reheating the combustion gases following expansion through the high pressure turbine; and a low pressure turbine for expanding the reheated combustion gases wherein the reheat combustor includes a fuel/gas mixer for mixing fuel with combustion gases that have been produced by the primary combustor and expanded through the high pressure turbine, a plurality of fuel injectors for injecting fuel into the fuel/gas mixer, an annular combustion chamber downstream of the fuel/gas mixer, in which the mixture of injected fuel and combustion gases is combusted prior to expansion through a low pressure turbine, wherein a wall of the fuel/gas mixer defines at least one convective cooling path through which cooling air flows, in use, to convectively cool the fuel/gas mixer; and the fuel injectors are arranged to inject the cooling air previously used for convective cooling of the fuel/gas mixer into mixing zones of the fuel/gas mixer together with the fuel.

A method of cooling a reheat combustor in a gas turbine engine is disclosed, including injecting cooling air previously used for convectively cooling at least a part of the reheat combustor by fuel injectors into mixing zones of the reheat combustor together with fuel.

BRIEF DESCRIPTION OF THE DRAWINGS

Exemplary embodiments of the disclosure will now be described, with reference to the accompanying drawings, in which.

Figure 1:
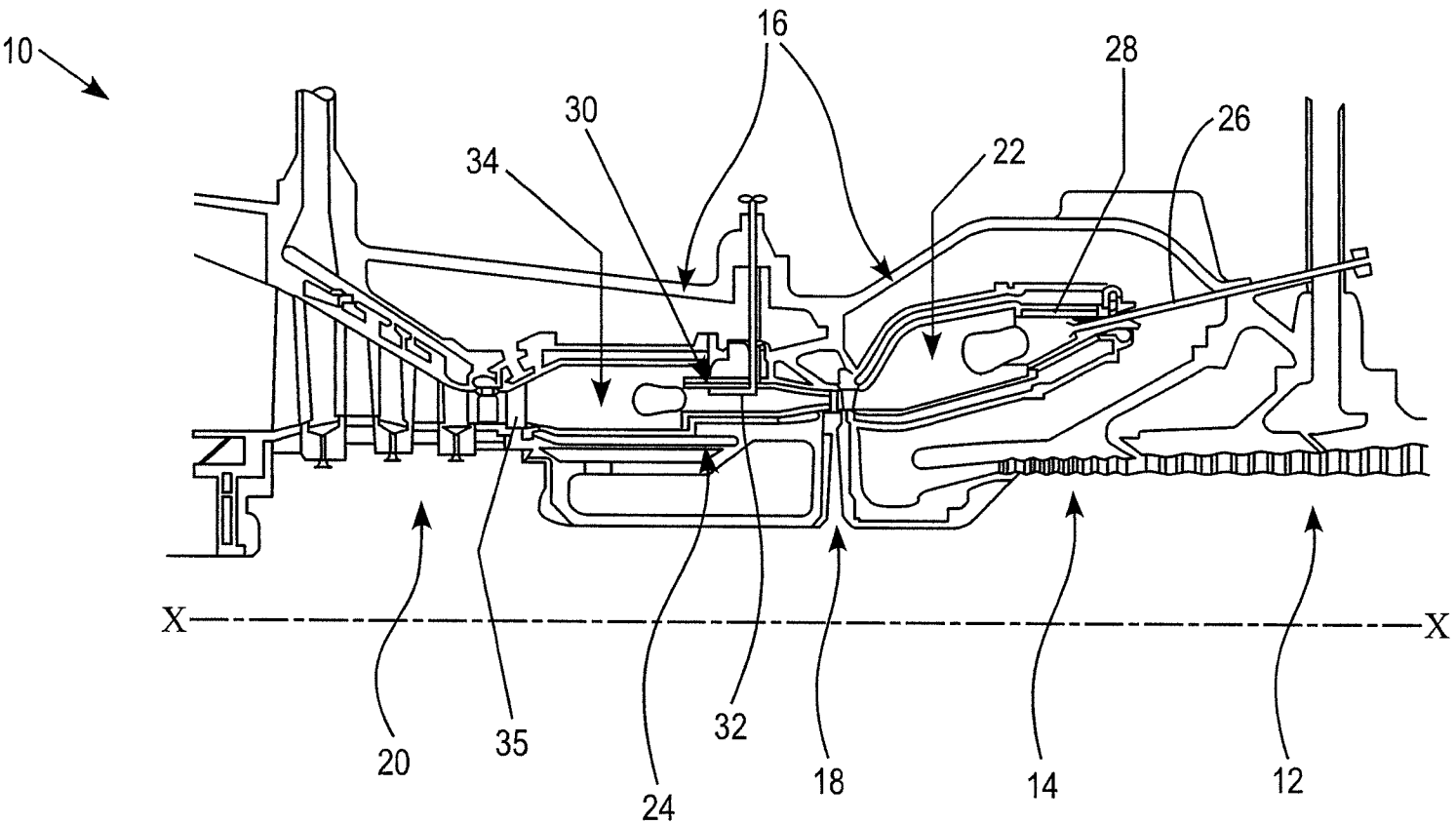
FIG. 1 PRIOR ART
FIG. 1 is a longitudinally and radially sectioned view of part of a gas turbine engine above the turbine rotational axis X-X and incorporating a known combustion system.

The drawings are all diagrammatic in character and are not to scale.

DETAILED DESCRIPTION

Exemplary embodiments of the disclosure provide an apparatus and a method of cooling a reheat combustor in a gas turbine engine, in which cooling air previously used for convectively cooling at least a part of the reheat combustor is injected by fuel injectors into mixing zones of the reheat combustor together with fuel. The mixing zones, and a reheat combustion chamber downstream of the mixing zones, can include the parts of the reheat combustor that are convectively cooled, cooling air from the combustion chamber being used to convectively cool the mixing zones. The fuel injectors can also be convectively cooled by the cooling air before it is injected into the mixing zones with the fuel.

A method of an exemplary embodiment of the disclosure can further include convectively cooling low pressure turbine inlet guide vanes (LP IGV's) downstream of the combustion chamber, cooling air therefrom then being used to convectively cool the reheat combustion chamber. The cooling air may be supplied from a single source, for example, a low pressure compressor of the gas turbine engine.

Exemplary embodiments of the present disclosure also provide a reheat combustor for a gas turbine engine, the reheat combustor including a fuel/gas mixer for mixing fuel with combustion gases that have been produced by a primary combustor and expanded through a high pressure turbine, a plurality of fuel injectors for injecting fuel into the fuel/gas mixer, and an annular combustion chamber downstream of the fuel/gas mixer, in which the mixture of injected fuel and combustion gases is combusted prior to expansion through a low pressure turbine, wherein a wall of the fuel/gas mixer defines at least one convective cooling path through which cooling air flows, in use, to convectively cool the fuel/gas mixer and the fuel injectors are arranged to inject the cooling air previously used for convective cooling of the fuel/gas mixer into mixing zones of the fuel/gas mixer together with the fuel.

An exemplary embodiment of the present disclosure provides a gas turbine engine including a primary combustor, a high pressure turbine for expanding combustion gases produced by the primary combustor, a reheat combustor for reheating the combustion gases following expansion through the high pressure turbine, and a low pressure turbine for expanding the reheated combustion gases. The reheat combustor includes a fuel/gas mixer for mixing fuel with combustion gases that have been produced by a primary combustor and expanded through a high pressure turbine, a plurality of fuel injectors for injecting fuel into the fuel/gas mixer, and an annular combustion chamber downstream of the fuel/gas mixer, in which the mixture of injected fuel and combustion gases is combusted prior to expansion through a low pressure turbine, wherein a wall of the fuel/gas mixer defines at least one convective cooling path through which cooling air flows, in use, to convectively cool the fuel/gas mixer and the fuel injectors are arranged to inject the cooling air previously used for convective cooling of the fuel/gas mixer into mixing zones of the fuel/gas mixer together with the fuel.

In an exemplary embodiment of the disclosure, the fuel injectors can also be convectively cooled, and to this end walls of each fuel injector can define a fuel injector convective cooling path and the fuel injector convective cooling path can be connected to receive cooling air from the at least one convective cooling path of the fuel/gas mixer.

In an exemplary embodiment of the disclosure, the fuel/gas mixer can include an overall annular structure that is segmented into a plurality of discrete mixing zones that are angularly spaced apart around the annulus. The circumferential extent of individual mixing zones can be defined by angularly spaced-apart side walls and their radial extent can be defined by radially inner and radially outer walls of the fuel/gas mixer. The side walls and/or at least one of the radially inner and outer walls can define fuel/gas mixer cooling paths through which the cooling air flows, in use, to convectively cool the fuel/gas mixer.

By convectively cooling the fuel/gas mixer walls and thereafter injecting the cooling air that has been used for convective cooling into the fuel/gas mixer together with the fuel, greater mixing of the cooling air and the injected fuel can be achieved than in the effusion-cooled fuel/gas mixer of the known reheat combustor described above. The cooling air can therefore be put to better use than in the effusion cooled fuel/gas mixer where it provides mostly for cooling of the walls of the fuel/gas mixer. Exemplary embodiments of the disclosure can enable the same cooling air to perform the duties of providing not only effective cooling of the fuel/gas mixer walls but also a reduction in the flame temperature in the combustion chamber, and thus a resultant reduction in undesirable NOx emissions.

In exemplary embodiments according to the disclosure, the side walls of the fuel/gas mixer and both of the radially inner and radially outer walls define fuel/gas mixer cooling paths. In this manner, all the fuel/gas mixer walls can be protected from the heating effects of the hot combustion gases, thus reducing the thermal stresses on the fuel/gas mixer structure and increasing the life of the reheat combustor.

The reheat combustion chamber according to an exemplary embodiment of the disclosure can include a wall defining at least one combustion chamber cooling path through which the cooling air flows, in use, to convectively cool the combustion chamber. The combustion chamber can be defined by radially inner and radially outer combustion chamber walls, either or both of which define a combustion chamber cooling path. Each cooling path can protect a combustion chamber wall from overheating by the hot combustion gases, so reducing the thermal stresses on the walls of the combustion chamber and increasing the life of the reheat combustor.

In an exemplary embodiment of the disclosure, the combustion chamber cooling paths and the fuel/gas mixer cooling paths can be arranged so that the cooling air flows through a combustion chamber cooling path and then through a fuel/gas mixer cooling path. The cooling air may thus not only be used for convectively cooling the combustion chamber but additionally for convectively cooling the fuel/gas mixer. The overall efficiency of the gas turbine engine can thereby be improved.

In an exemplary embodiment of the disclosure, the radially inner combustion chamber cooling path and the radially inner fuel/gas mixer cooling path can communicate to define a common radially inner cooling path through which the cooling air may flow to convectively cool the inner walls of both the annular combustion chamber and the fuel/gas mixer. Similarly, the radially outer combustion chamber cooling path and the radially outer fuel/gas mixer path can communicate to define a common radially outer cooling path through which the cooling air may flow to convectively cool the outer walls of both the annular combustion chamber and the fuel/gas mixer.

To simplify construction of the reheat combustor and maximize efficiency, all the convectively cooled cooling paths, i.e., both radially inner and radially outer cooling paths, can share a common supply of cooling air.

Injection of the cooling air into the fuel/gas mixer together with the fuel can bring about the advantage that a separate source of carrier air, such as that required for the effusion-cooled fuel/gas mixer of the known reheat combustor described above, is not needed. The loss of efficiency associated with the provision of the carrier air can be eliminated.

There can be one or more fuel injectors per discrete mixing zone of the fuel/gas mixer. Fuel injectors that extend radially into the fuel/gas mixer from an outer wall can be used to inject the fuel and cooling air, each fuel injector including a plurality of fuel injector tubes arranged to inject the fuel into the fuel/gas mixer in the downstream direction. This arrangement can make it possible to eliminate the high pressure turbine outlet guide vanes (HP OGV's) and the vortex generators that are provided in the known gas turbine engine described above. Elimination of the HP OGV's and the vortex generators is possible because injector tubes, or the jets of fuel expelled from them, can present the same profile to the flow coming from the high pressure turbine, no matter from which upstream direction the flow approaches the injectors. The cross-sectional area of the fuel/gas mixer can therefore be reduced, thereby increasing the velocity of the flow through it without any increase in pressure drop, due to the absence of the outlet guide vanes and the vortex generators.

Figure 2:
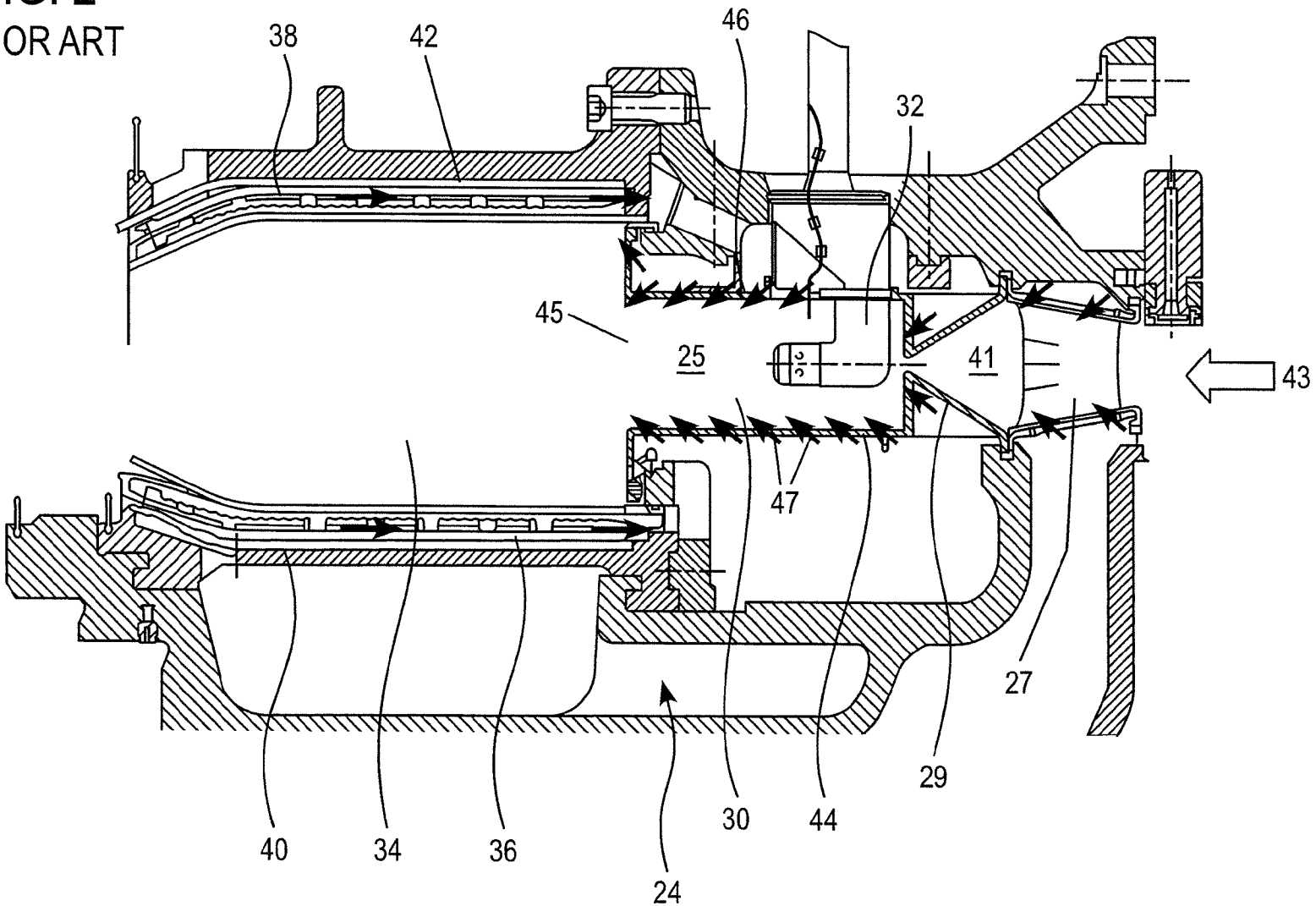
FIG. 2 PRIOR ART
FIG. 2 is a longitudinally and radially sectioned view illustrating a known reheat combustor forming part of the combustion system shown in FIG. 1.

Because the fuel is injected into the fuel/gas mixer together with cooling air that has been used for convective cooling of at least the fuel/gas mixer, there can be a significant mass flow rate of low pressure air through the fuel/gas mixer, and the size and number of the fuel injectors can be greater than in the known reheat combustor described with respect to FIGS. 1 and 2.

The fuel injectors can be located near the inlets of the mixing zones, or at points intermediate their inlets and outlets. Furthermore, either the entire length of the fuel/gas mixer walls can be convectively cooled before the cooling air is injected into the fuel/gas mixer with the fuel, or only the parts of the fuel/gas mixer walls that are downstream of each fuel injector can be convectively cooled. In the latter case, the parts of the fuel/gas mixer upstream of the fuel injector may be effusion cooled or film cooled.

The fuel injectors can be in the form of struts or the like that extend radially into or across the mixing zones. The above-mentioned plurality of fuel injector tubes that form part of each fuel injector can enable more even distribution of injected fuel and air within the mixing zones. In an exemplary embodiment of the disclosure, the convective cooling path in each fuel injector can be defined between an inner fuel passage and an outer wall of each fuel injector and the plurality of radially spaced fuel injector tubes extend from the fuel passage through the outer wall, thereby to inject jets of fuel into the mixing zones. In this arrangement, each injector tube projects through a corresponding hole in the outer wall, the holes being of larger cross-section than the tubes so that cooling air can exit from the fuel injector cooling path into the fuel/gas mixer as jets of air, whereby in use each fuel jet is surrounded by an annular air jet.

Whereas the above described fuel injector can inject only one type of fuel, e.g., either gaseous or liquid, many gas turbine engine fuel systems make provision for the injection of two different types of fuel, where the two different fuels may be injected either simultaneously, or during different parts of the engine operating cycle. These are known as "dual fuel" systems. In an exemplary embodiment of the disclosure, therefore, the fuel injectors can be constructed as dual fuel injectors. Each fuel injector includes an outer wall, a first fuel passage for a first fuel and second fuel passage for a second fuel. The second fuel passage is located inside the first fuel passage. The fuel injector convective cooling paths are defined between the first fuel passage and the outer wall of each fuel injector. A first fuel is injectable into the mixing zones through a plurality of radially spaced first injector tubes that extend from the first fuel passage through the outer wall of the fuel injector. A second fuel is injectable into the mixing zones through a plurality of radially spaced second injector tubes that extend from the second fuel passage through a wall of the first fuel passage and the outer wall of the fuel injector. The second injector tubes are of smaller cross-section than the first injector tubes and extend concentrically through the first injector tubes. Each first injector tube projects through a corresponding hole in the outer wall of the fuel injector, the holes being of larger cross-section than the first injector tubes. In use cooling air exits from the fuel injector cooling path into the mixing zones as annular jets of air surrounding jets of the first and/or second fuel.

The first fuel passage can be for gaseous fuel and the second fuel passage can be for liquid fuel.

An annular array of low pressure turbine inlet guide vanes (LP IGV's) can be provided at the exit of the reheat combustion chamber to direct the reheated combustion gases into the low pressure turbine. In an exemplary embodiment of the disclosure, the LP IGV's can be convectively cooled by the same air used for convective cooling of the reheat combustor, i.e., a convective cooling path in each LP IGV communicates with at least one convective cooling path in the reheat combustion chamber. It will therefore be appreciated that a single source of cooling air can be used to successively cool the LP IGV's, the annular combustion chamber, the fuel/gas mixer and the fuel injectors, before the fuel injectors finally inject the cooling air into the fuel/gas mixer with the fuel. This can achieve an increase in efficiency relative to the known gas turbine engine described above, in which cooling air used for effusion or film cooling of the LP IGV's is simply released into the main flow and one or more separate sources of cooling air are employed for cooling other parts of the reheat combustor and the HP OGV's. The cooling air for the above convective cooling duty can be supplied by the low pressure compressor of the gas turbine engine in which the reheat combustor is located. Although in this exemplary embodiment the cooling air has absorbed heat from the LP IGV's, the reheat combustion chamber, the fuel/gas mixer and the fuel injectors, before it is injected into the fuel/gas mixer, it can still have a significant cooling and shielding effect when injected coaxially with the fuel and can therefore contribute towards a reduction in the reheat flame temperature, thus reducing the level of undesirable NOx emissions.

Figure 3A:
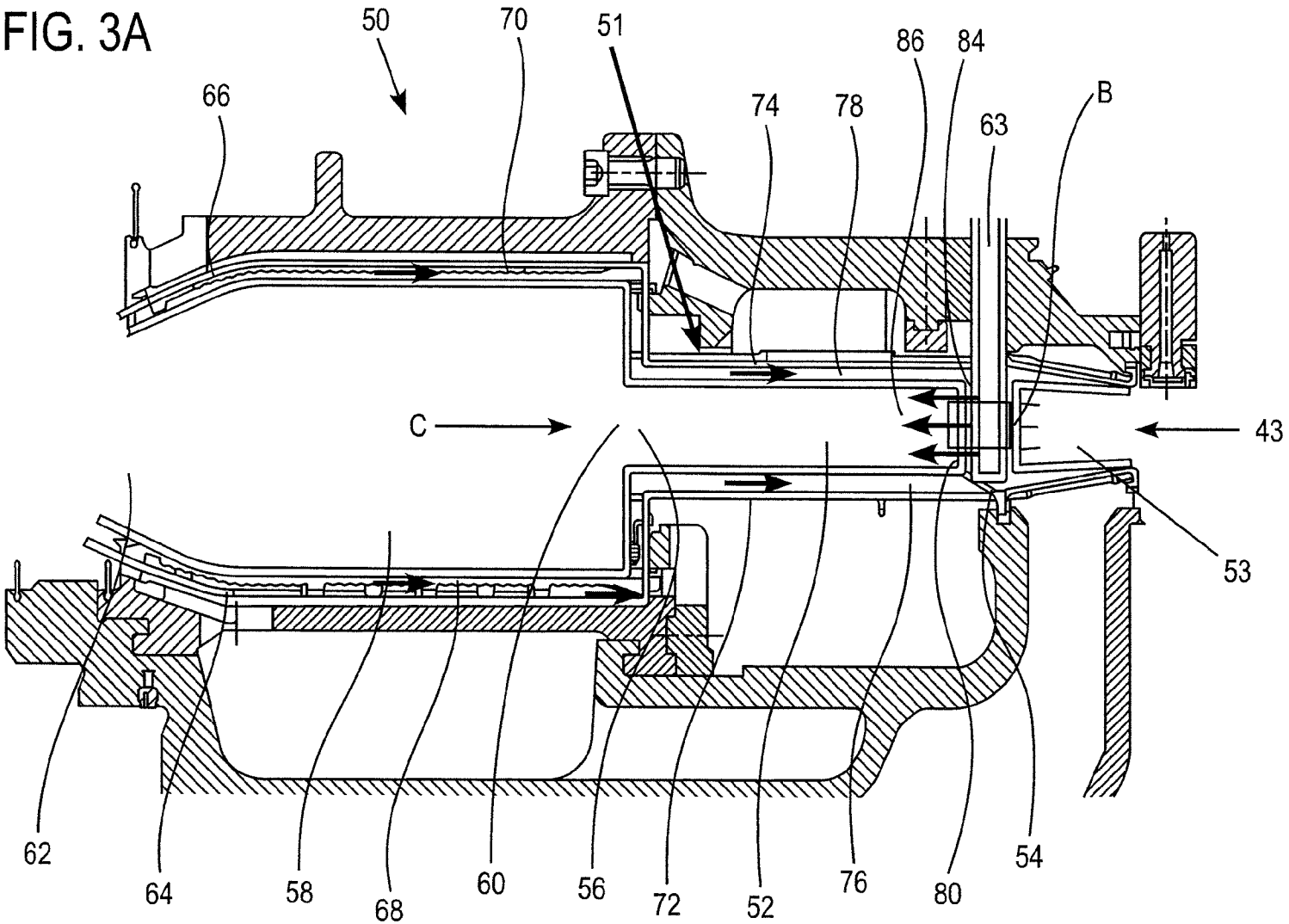
FIG. 3A is a longitudinally and radially sectioned view illustrating a reheat combustor according to an exemplary embodiment of the disclosure.

FIG. 3A illustrates an exemplary embodiment of a reheat combustor 50 for a gas turbine engine. Except for certain aspects of the reheat combustor 50 to be described below, the engine of which the reheat combustor is a part is a similar construction to the known reheated gas turbine engine 10 described previously with respect to FIGS. 1 and 2. The reheat combustor 50 includes a fuel/gas mixer 51 of substantially annular form. As indicated in FIG. 3C, which is a view the direction of arrow C in FIG. 3A, the upstream end of the combustor is segmented into an annular array of circumferentially spaced mixing zones 52, defined by side walls 52A. Each mixing zone 52 has an inlet 53 receiving combustion gases that have been produced by a primary combustor and then expanded through a high pressure turbine. The reheat combustor 50 also includes an annular combustion chamber 58 located adjacent to and downstream from the fuel/gas mixer 51. Fuel/air/gas mixture flows through outlets 56 of the individual mixing zones 52 and expands into the annular combustion chamber 58 through its inlet 60.

The reheat combustor 50 includes an annular array of circumferentially spaced-apart fuel injectors 63, only one of which is shown in FIG. 3A, though several are shown in FIG. 3C. Each fuel injector injects fuel and air into a mixing zone 52 of the fuel/gas mixer 51. The number and angular spacing of the mixing zones and fuel injectors employed should be sufficient to ensure that the circumferential distribution of mixed fuel, air and combustion gases around the annular combustion chamber 58 enables efficient combustion. For example, if a mixing zone 52 is of a sufficiently large angular extent between its circumferentially spaced-apart side walls 52A, it can be necessary for it to have more than one fuel injector in order to ensure adequate circumferential distribution of mixed fuel, air and combustion gases.

The velocity of the fuel mixture in the downstream direction slows abruptly because of its expansion into the larger cross-sectional area of the annular combustion chamber 58, whereupon the fuel in the mixture can spontaneously combust or auto-ignite in the combustion chamber due to the presence of the hot combustion gases. Mixing of the injected fuel and expanded combustion gases mainly occurs in the mixing zones 52 and combustion of the mixture mainly occurs in the combustion chamber 58 but it should be appreciated that combustion processes can begin in the fuel/gas mixer 51 and that mixing will continue in the combustion chamber 58.

The annular combustion chamber 58 has walls of a double-skinned construction including radially inner and radially outer combustion liners 64, 66, which define respective radially inner and radially outer combustion chamber cooling paths 68, 70, through which cooling air flows to thereby convectively cool the combustion chamber walls. The mixing zones 52 also have walls of a double-skinned construction, thereby defining respective radially inner and radially outer fuel/gas mixer cooling paths 76, 78, for convective cooling. It is preferred that the side walls 52A of the mixing zones 52 are also double-skinned to provide further convective cooling paths in the fuel/gas mixer structure.

In the exemplary embodiment, the radially inner fuel/gas mixer cooling path 76 is in series flow communication with the radially inner combustion chamber cooling path 68, thereby defining a common radially inner convective cooling path for the reheat combustor. Likewise, the radially outer fuel/gas mixer cooling path 78 is in series flow communication with the radially outer combustion chamber cooling path 70, thereby defining a common radially outer convective cooling path for the reheat combustor. These cooling combustion chamber and fuel/gas mixer cooling paths can receive their supply of cooling air from a common source, for example, a low pressure compressor of the gas turbine engine.

In FIGS. 3A and 3C, the circumferentially spaced side walls 52A of each mixing zone 52 can have internal cooling flow paths and are in flow communication with either or both of the radially inner and radially outer combustion chamber cooling paths. Alternatively, to enable a simpler design of the reheat combustor and its cooling system, it can be arranged that the cooling air from the combustion chamber liners (i.e., the radially inner and outer combustion chamber cooling paths 68, 70), flows into a plenum chamber surrounding the fuel/air mixer, and that all the cooling paths in the fuel/gas mixer are connected to receive their supply of cooling air from the plenum chamber.

The fuel injectors 63 can be in the form of hollow struts 80 that extend across the inlet 53 of the fuel/gas mixer 51. The struts 80 can be of circular, elliptical or similar cross-section. Each strut has a cooling air path 84 defined between an outer wall and an inner wall of the strut to enable convective cooling of the fuel injectors 63. The fuel injectors 63 can be configured so that after the cooling air has been used for convective cooling of the annular combustion chamber 58, the fuel/gas mixer 51, and the fuel injectors 63, the spent cooling air is exhausted from the fuel injectors 63 into the fuel/gas mixing zones 52 with the fuel, as denoted by the reference numeral 86. The spent cooling air thus facilitates injection of the fuel and mixes with it, thus reducing the temperature of the resulting mixture of fuel and expanded combustion gases that are created inside the mixing zones 52.

Figure 3B:
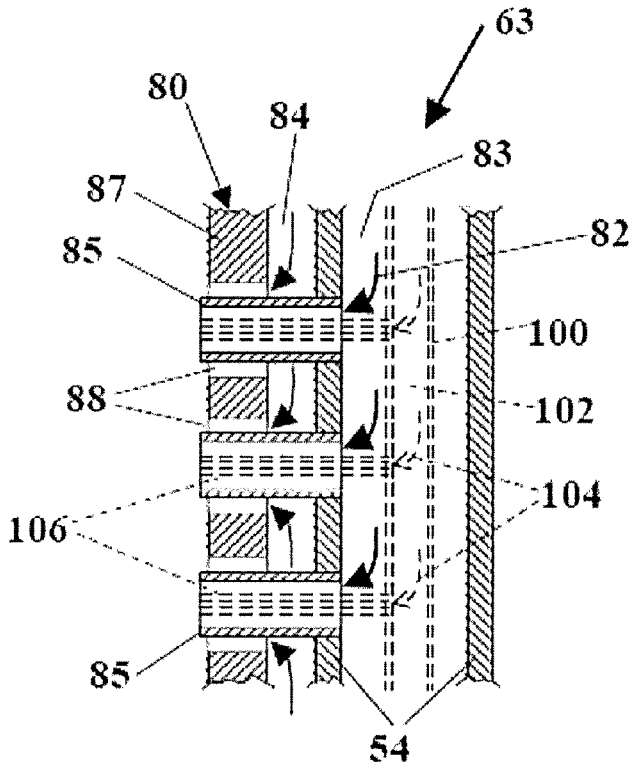
FIG. 3B is an enlarged view of rectangular area B in FIG. 3A.
Figure 3C:
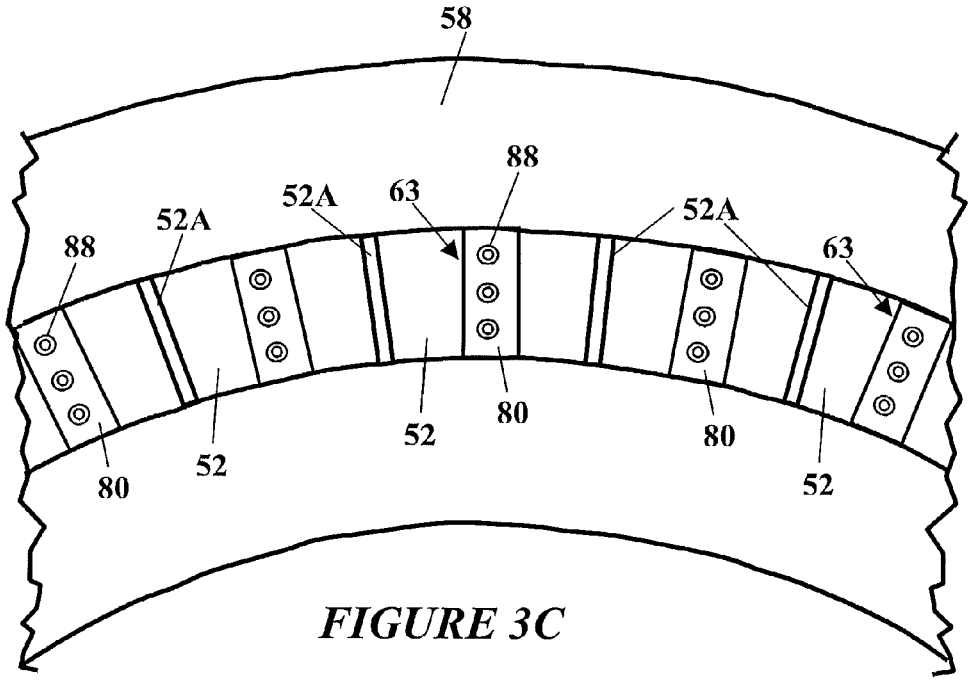
FIG. 3C is a view looking in the direction of arrow C in FIG. 3A.

The structure of the fuel injector 63 is illustrated in more detail in FIG. 3B, which is a view of the part within box B in FIG. 3A. FIGS. 3A and 3B together show that fuel 82 flows into a tube 54 that is blind-ended at its radially inner end. Tube 54 thus defines a fuel passage 83 within strut 80. Jets of fuel 82 issue from passage 83 into the mixing zone 52 through a number of radially spaced-apart fuel injector tubes 85 that are securely fixed in the wall of the tube 54 and that penetrate both the tube wall and the outer skin 87 of the strut 80, which forms the outer wall of the injector cooling air path 84. Air that has been used to convectively cool the injector 63 exits from the fuel injector cooling path 84 into mixing zone 52 through air exit holes 88 provided in the outer skin 87 of each strut 80. The distal or free end of each injector tube 85 projects through a corresponding one of the air exit holes 88, the holes 88 being of larger diameter than the external diameter of the tubes 85, so that each jet of fuel issuing from the tubes 85 is surrounded by a coaxial annular jet of cooling air. The air therefore has a cooling and shielding effect, so helping to reduce the reheat flame temperature and hence NOx emissions.

To provide the reheat combustor with "dual fuel" capability, the fuel injectors 63 can be constructed to inject two types of fuel, for example, gas fuel and liquid fuel. This is diagrammatically illustrated in FIG. 3B by dashed lines. In an exemplary embodiment, each fuel injector strut 80 includes an outer wall 87, a first tube 54 defining a first fuel passage 83 and a second tube 100, located inside the first tube 54, defining a second fuel passage 102. The fuel 82 in passage 83 can be gaseous, for example, natural gas, and the fuel 104 in passage 102 can be liquid, for example, diesel or fuel oil. In addition to the radially spaced injector tubes 85 that extend from fuel passage 83 through the wall of tube 54 and the outer wall 87 of the fuel injector strut 80, a second set of radially spaced injector tubes 106 can be provided to inject fuel 104 into the mixing zone 52 of the fuel/gas mixer 51. Injector tubes 106 are of smaller cross-section than injector tubes 85 and extend from the second or inner fuel passage 102 through its wall as defined by tube 100 and then concentrically through the injector tubes 85. Hence, if it is desired to burn both fuels simultaneously within the reheat combustor, jets of the second fuel can be injected into the fuel/gas mixer 51 concentrically within jets of the first fuel. Furthermore, as previously described, because injector tubes 85 project through holes 88 in the outer wall 87 of the fuel injector strut, cooling air exits from the fuel injector cooling path 84 into the fuel/gas mixer 51 as annular jets of air. Each such air jet therefore surrounds and is coaxial with a jet of the first fuel and/or a jet of the second fuel, according to an operating mode of the reheat combustor.

FIG. 3A shows the coaxial jets 86 of fuel and cooling air issuing from the fuel injectors 63 in a direction aligned with the downstream direction, and this is an orientation of the injector tubes and their surrounding air exit holes 88.

The relative dimensions of the tubes 85, 106 and the holes 88 can be chosen as required to obtain the desired fuel mixing and combustion characteristics and will depend on a variety of factors but can be ascertained by the use of computerized fluid flow modeling and rig tests. If necessary or desirable for correct functioning of the mixing zones 52 and the combustion chamber 58, the number of air holes 88 can be greater than the number of injector tubes 85, those air holes that are not paired with corresponding injector tubes being located, for example, in between adjacent injector tubes, or near the walls of the mixing zone 52 and radially spaced-apart.

The temperature of the cooling air can increase by the time it is injected into the mixing zones 52, because it has been used to convectively cool multiple component parts of the reheat combustor 50. However, its temperature can still be sufficiently low (relative to the temperature of the expanded combustion gases that have flowed into the mixing zones 52 from the high pressure turbine 18) to have a significant cooling effect. This cooling effect can be further enhanced by the fact that the cooling air has a high mass flow rate, for example, of the order of twice the mass flow rate of the carrier air injected with the fuel in the known reheat combustor 24 described with reference to FIG. 1. The reduction in the temperature of the mixture of the injected fuel and the expanded combustion gases can bring about a reduction in the flame temperature when the mixture is combusted in the annular combustion chamber 58 and a consequent reduction in the level of undesirable NOx emissions.

Unlike the known gas turbine engine described with reference to FIG. 1, injection of the convective cooling air into the fuel/gas mixer 51 together with the fuel can render it unnecessary to provide the fuel injectors 62 with carrier air from a separate source. A gas turbine engine including the reheat combustor 50 can therefore be more efficient than the known gas turbine engine 10.

Use of the convectively cooled tube-type fuel injectors 63 can enable the high pressure turbine outlet guide vanes 27 and the vortex generators 29 that are required in the known gas turbine engine 10 of FIG. 1 to be eliminated because injector tubes, or the fuel jets that issue from them, can present the same profile to the downstream flow of combustion gases no matter what transverse velocity components are present in the flow. This can result in a further increase in the efficiency and power output of a gas turbine engine that includes the reheat combustor 50, because the pressure drop through the fuel/gas mixer 51 is reduced. The absence of the high pressure turbine outlet guide vanes 27 and the vortex generators 29 also enables the cross-sections of the mixing zones 52 to be reduced without any increase in pressure drop, thereby increasing the velocity of the main flow of combustion gases through the reheat combustor 50. This can be advantageous as it enables fuels, such as syngas and dry oil, to be combusted in the reheat combustor 50 without flashback, due to the reduced residence time in the mixing zones 52 and the annular combustion chamber 58.

Figure 4:
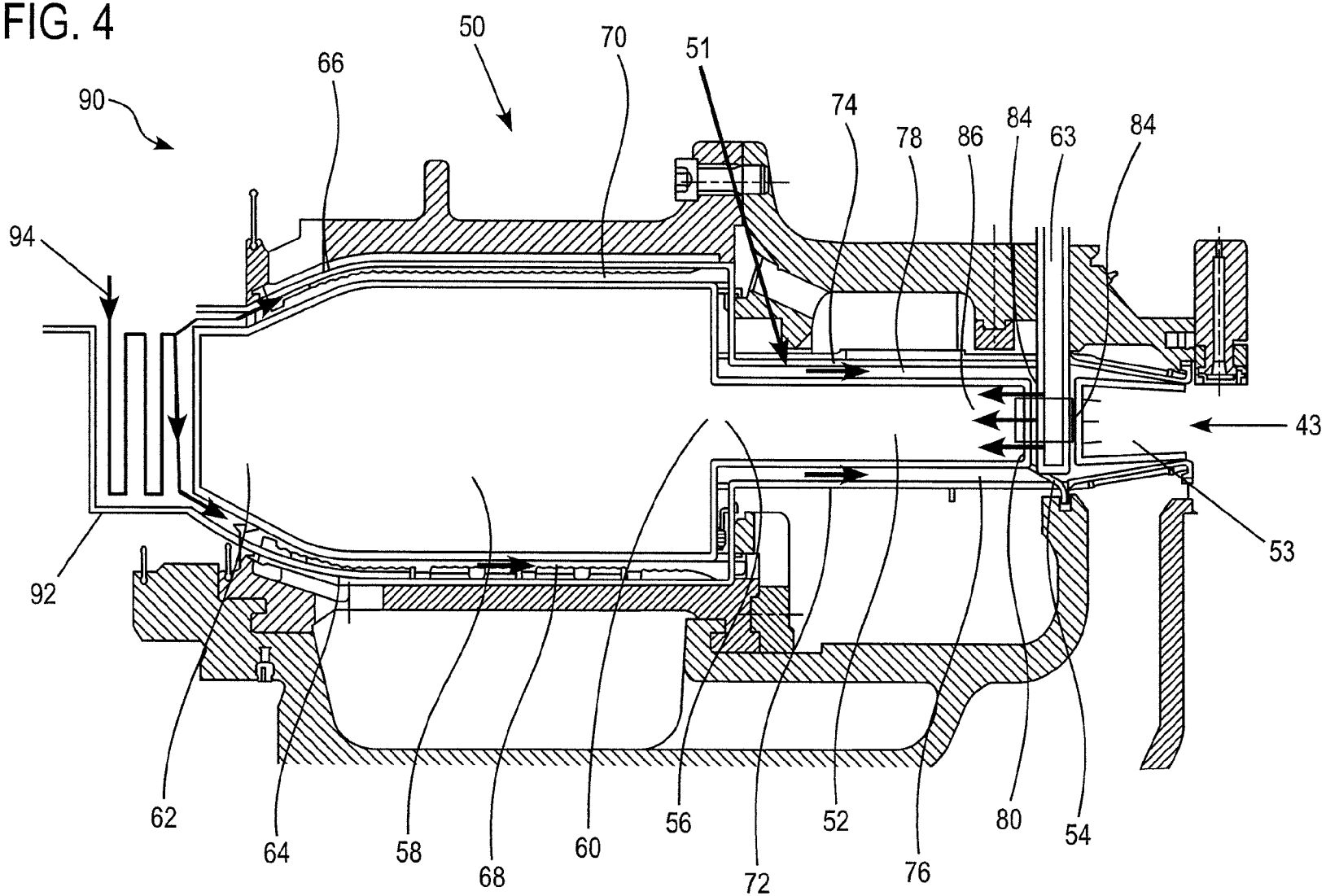
FIG. 4 is a view similar to FIG. 3A, illustrating an exemplary embodiment of the disclosure.

Referring now to FIG. 4, there is shown an exemplary embodiment of a reheat combustor 90 according to the disclosure. The reheat combustor 90 is similar in construction and operation to the reheat combustor 50 described above. Corresponding components are thus designated using the same reference numerals and will not be described again.

The outlet 62 of reheat combustor 90 exhausts into the low pressure turbine through an array of circumferentially spaced inlet guide vanes (LP IGV's), one of which is shown schematically at the reference numeral 92. Each of the LP IGV's 92 includes a vane cooling path 94 through which cooling air flows for convective cooling of the vanes 92. In an exemplary embodiment, the same cooling air performs multiple cooling duties. It is supplied by the low pressure compressor and flows initially through the guide vane cooling path 94 before it divides to flow through two parallel flow paths, i.e., the radially inner cooling paths 68, 76 and the radially outer cooling paths 70, 78, inside the walls of the combustion chamber 58 and the mixing zones 52 of the fuel/gas mixer 51. The radially inner and outer flow paths are then merged to convectively cool the fuel injectors 63, which then inject the spent cooling air into the mixing zones 52 together with the fuel.

It will be understood from the above that because a separate supply of cooling air is not required to provide for effusion cooling or film cooling of the LP IGV's 92, a further increase in efficiency compared with known gas turbine engines can be obtained with a gas turbine engine employing the reheat combustor 90.

Embodiments have been described above purely by way of example, and modifications can be made within the scope of the disclosure. Thus, the breadth and scope of the present disclosure should not be limited by any of the above-described exemplary embodiments. For example, it is possible that convective cooling could be employed only for the fuel/gas mixer 51 before the cooling air is injected by the fuel injectors 63 into the mixing zones 52 with the fuel, the annular combustion chamber 58 being cooled other than by convection cooling.

Although radially inner and radially outer double-skinned walls 64, 66, 72, 74 are provided to define respective radially inner and radially outer convective cooling paths 68, 70, 76, 78 to cool the combustion chamber 58 and the fuel/gas mixer 51, it can be possible to substitute effusion cooled walls for either the inner or the outer convectively cooled walls, thereby defining only a radially inner or a radially outer combustion chamber-fuel/gas mixer cooling path.

Due to eliminating the need for HP OGV's and vortex generators, the above description has focused on the use of fuel injectors 63 including multiple injector tubes for the injection of fuel together with spent cooling air into the mixing zones. However, other known types of fuel injectors could alternatively be used, provided that such injectors could be modified to inject the fuel together with the spent cooling air.

It should be understood that fuel injectors 63 can be located axially at any suitable position at or downstream of inlet 53 within the mixing zones 52, as necessary to obtain desired fuel mixing and ignition characteristics for the combustion process. Moreover, the entire lengths of the mixing zones 52 can be convectively cooled, as shown in FIGS. 3A and 4, or only the parts of the mixing zones 52 that are downstream of the fuel injectors 63 can be convectively cooled.

Note that each feature disclosed in the specification, including the claims and drawings, can be replaced by alternative features serving the same, equivalent or similar purposes, unless expressly stated otherwise. Unless the context clearly requires otherwise, throughout the description the disclosure is to be construed in an inclusive as opposed to an exclusive or exhaustive sense.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A reheat combustor for a gas turbine engine, comprising:

a fuel/gas mixer for mixing fuel with combustion gases that have been produced by a primary combustor and expanded through a high pressure turbine;

a plurality of fuel injectors for injecting fuel into the fuel/gas mixer; and an annular combustion chamber downstream of the fuel/gas mixer, in which the mixture of injected fuel and combustion gases is combusted prior to expansion through a low pressure turbine;

a wall of the fuel/gas mixer defining at least one convective cooling path through which cooling air flows, in use, for convectively cooling the fuel/gas mixer; and wherein the fuel injectors are arranged to inject the cooling air previously used for convective cooling of the fuel/gas mixer into mixing zones of the fuel/gas mixer together with the fuel.

2. A reheat combustor according to claim 1, wherein the wall of each fuel injector defines a fuel injector convective cooling path and the fuel injector convective cooling path is connected to receive cooling air from the at least one convective cooling path of the fuel/gas mixer.

3. A reheat combustor according to claim 1, the fuel/gas mixer comprising:

an annular structure that is segmented into a plurality of discrete mixing zones, each mixing zone having at least one fuel injector, the mixing zones being angularly spaced apart around the annulus, a circumferential extent of individual mixing zones being defined by angularly spaced-apart side walls and their radial extent being defined by radially inner and radially outer walls of the fuel/gas mixer, the side walls and/or at least one of the radially inner and outer walls defining the at least one fuel/gas mixer convective cooling path through which the cooling air flows, in use, to convectively cool the fuel/gas mixer.

4. A reheat combustor according to claim 1, the combustion chamber comprising:

at least one of a radially inner and a radially outer combustion chamber wall that defines a combustion chamber cooling path through which the cooling air flows, in use, to convectively cool the combustion chamber.

5. A reheat combustor according to claim 4, wherein at least one cooling path of the combustion chamber and at least one cooling path of the fuel/gas mixer are connected to enable cooling air to flow through a combustion chamber cooling path and then through a fuel/gas mixer cooling path.

6. A reheat combustor according to claim 1, comprising:

an annular array of low pressure turbine inlet guide vanes (LP IGV's) provided at an exit of the reheat combustion chamber and a convective cooling path in each LP IGV communicating with at least one convective cooling path in the reheat combustion chamber.

7. A reheat combustor according to claim 1, wherein all the convectively cooled cooling paths share a common supply of cooling air.

8. A reheat combustor according to claim 2, wherein the fuel injectors extend radially into the mixing zones and are arranged to inject fuel into the mixing zones coaxially inside annular jets of the cooling air, injection being in the downstream direction.

9. A reheat combustor according to claim 8, wherein the fuel injector convective cooling paths are defined between an inner fuel passage and an outer wall of each fuel injector and fuel is injectable into the mixing zones through a plurality of radially spaced-apart fuel injector tubes that extend from a fuel passage through corresponding holes in the outer wall, the holes being of larger cross-section than the tubes, whereby in use cooling air exits from the fuel injector cooling path into the mixing zones as annular jets of air surrounding jets of fuel.

10. A reheat combustor according to claim 8, wherein the fuel injectors are dual fuel injectors each fuel injector comprising:

an outer wall;

a first fuel passage for a first fuel; and a second fuel passage for a second fuel; wherein the second fuel passage is located inside the first fuel passage;

the fuel injector convective cooling paths are defined between the first fuel passage and the outer wall of each fuel injector;

a first fuel is injectable into the mixing zones through a plurality of radially spaced first injector tubes that extend from the first fuel passage through the outer wall of the fuel injector;

a second fuel is injectable into the mixing zones through a plurality of radially spaced second injector tubes that extend from the second fuel passage through a wall of the first fuel passage and the outer wall of the fuel injector, the second injector tubes being of smaller cross-section than the first injector tubes and extending concentrically through the first injector tubes; and each first injector tube projects through a corresponding hole in the outer wall of the fuel injector, the holes being of larger cross-section than the first injector tubes, whereby in use cooling air exits from the fuel injector cooling path into the mixing zones as annular jets of air surrounding jets of the first and/or second fuel.

11. A gas turbine engine, comprising:

a low pressure compressor;

a high pressure compressor;

a primary combustor;

a high pressure turbine for expanding combustion gases produced by the primary combustor;

a reheat combustor for reheating the combustion gases following expansion through the high pressure turbine; and a low pressure turbine for expanding the reheated combustion gases wherein the reheat combustor comprises:

a fuel/gas mixer for mixing fuel with combustion gases that have been produced by the primary combustor and expanded through the high pressure turbine;

a plurality of fuel injectors for injecting fuel into the fuel/gas mixer;

an annular combustion chamber downstream of the fuel/gas mixer, in which the mixture of injected fuel and combustion gases is combusted prior to expansion through a low pressure turbine;

wherein a wall of the fuel/gas mixer defines at least one convective cooling path through which cooling air flows, in use, to convectively cool the fuel/gas mixer; and the fuel injectors are arranged to inject the cooling air previously used for convective cooling of the fuel/gas mixer into mixing zones of the fuel/gas mixer together with the fuel.

12. A gas turbine engine according to claim 11, wherein the wall of each fuel injector defines a fuel injector convective cooling path and the fuel injector convective cooling path is connected to receive cooling air from the at least one convective cooling path of the fuel/gas mixer.

13. A gas turbine engine according to claim 11, wherein the cooling air for convective cooling is supplied by the low pressure compressor.

14. A method of cooling a reheat combustor including a mixer for mixing fuel with combustion gases that have been produced by a primary combustor in a gas turbine engine, comprising:

injecting cooling air by fuel injectors into mixing zones of the reheat combustor together with fuel, wherein the injected cooling air was previously used for convectively cooling at least part of a wall of the mixing zone of the mixer downstream of the fuel injectors, the wall defining at least one convective cooling path through which the cooling air flows.

15. A method according to claim 14, comprising:

convectively cooling the fuel injectors by the cooling air before it is injected into the mixing zones with the fuel.

16. A method of cooling a reheat combustor in a gas turbine engine, comprising:

injecting cooling air previously used for convectively cooling at least a part of the reheat combustor by fuel injectors into mixing zones of the reheat combustor together with fuel;

convectively cooling a combustion chamber downstream of the mixing zones;

convectively cooling mixing zones with cooling air therefrom;

convectively cooling low pressure turbine inlet guide vanes (LP IGV's) downstream of the combustion chamber; and convectively cooling the combustion chamber with cooling air therefrom.

17. A method according to claim 16, comprising:

supplying the cooling air from a single source.

18. A method according to claim 16, comprising:

supplying the cooling air from a low pressure compressor of the gas turbine engine.

* * * * *